United States Patent [19]

Jörg

[11] 4,242,086

[45] Dec. 30, 1980

[54] TRANSPORTABLE TREATMENT RECLINER

[76] Inventor: Siegfried Jörg, Geishügel 9, 8631 Ahorn, Fed. Rep. of Germany

[21] Appl. No.: 950,602

[22] Filed: Oct. 11, 1978

[30] Foreign Application Priority Data

Oct. 2, 1977 [DE] Fed. Rep. of Germany ..... 2747321

[51] Int. Cl.[3] ..... A61G 15/00

[52] U.S. Cl. ..... 433/33; 297/192

[58] Field of Search ..... 32/22; 297/192; 433/33

[56] References Cited

U.S. PATENT DOCUMENTS

| | | | |
|---|---|---|---|
| 3,081,542 | 3/1963 | Sherfey | 32/22 |
| 3,089,741 | 5/1963 | Burton | 32/22 |

*Primary Examiner*—Robert Peshock

*Attorney, Agent, or Firm*—Max Fogiel

[57] ABSTRACT

A transportable treatment recliner continuously adjustable in height and from the seating to the lying position, and rotary about the vertical axis, for medical, particularly dental or surgical care, characterized in that the recliner can be disassembled manually without tools into its individual parts or assemblies which can be placed in a transport container for saving space, with the component parts or assemblies being connected or fastened to the recliner upper portion by loosenable clamp and plug connections and the recliner upper portion consisting of three hinged parts to be laid flat. A pneumatic spring, which can be locked by a control lever, may be fastened to the rear side of the back part. This spring is hinged on its other end to an extension on the seating part. Between the seating part and the foot part there is a click-stop adjustment actuated via a clamp lever. The pneumatic spring may be held on the extension by an angled pin with turnable safety tab. The recliner upper portion has laterally pulled-up rims and adhesive tapes arranged on its topside for attaching a cushion with matching adhesive tapes, possibly velcro tapes, on its bottom. The cushion consists of three interconnected parts matching the recliner upper portion.

20 Claims, 4 Drawing Figures

TRANSPORTABLE TREATMENT RECLINER

BACKGROUND OF THE INVENTION

The invention relates to a transportable treatment recliner which is continuously adjustable in height and from the seating to the lying position, and rotary about the vertical axis, for medical, particularly dental or surgical care.

Particularly in the military area, but also in the civilian area, it is necessary to perform medical treatments on the spot. This requires, like clinical treatment, a treatment chair or a treatment recliner so that the necessary treatment, be it dental or surgical, may be administered without difficulties.

Such a treatment recliner must satisfy various requirements. First, it must be easily transportable so that it may be moved from one location to another treatment location without difficulty. On the other hand, such a transportable treatment recliner must be capable of being installed quickly without requiring special knowledge. The treatment recliner necessary in the field, furthermore, must be universally usable, compact and susceptible to few troubles, hence it must be built ruggedly; it is important that it stands securely after erection so that shaking and accompanying difficulty in treatment of the patient is avoided.

Treatment recliners used in hospitals or in dental offices cannot be used in the field or only conditionally, because they are much too bulky for transport and can be moved to the required location only under extreme difficulties.

It is, therefore, the object of the present invention to create a treatment recliner of the aforementioned type which satisfies the above requirements, it further being required that the entire or at least the essential instrumentarium required for a dental or surgical intervention is transportable, combined into one unit to save space.

SUMMARY OF THE INVENTION

This object is achieved by making the recliner so that it can be disassembled manually without tools into individual parts or assemblies which can be accommodated in a shipping container to save space, with the individual parts or assemblies being connected with one another by loosenable clamping and plug connections or fastened to the upper portion of the recliner, and the recliner upper portion, consisting of three hingedly connected segments, angularly fixable relative to one another, can be folded flat. In this manner the treatment recliner can be disassembled at all times for transport into its individual parts or into assemblies, without requiring tools, so that this disassembly and the reassembly can be undertaken by an unskilled or untrained person. In the process, the recliner upper portion is folded into a flat package after the inserted individual parts or assemblies are pulled off.

Expediently, the recliner upper portion according to a further improvement of the invention, has laterally pulled-up rims and adhesive tapes located on its topside for the detachable fastening of a cushion, corresponding adhesive tapes being provided on the bottom side of the cushion. Through the laterally pulled-up rims of the recliner upper portion, the cushion is placed correctly on the upper portion of the recliner, so that the adhesive tapes which preferably are velcro tapes come directly into mutual contact so that the cushion is held securely on the recliner upper portion, but can be taken off at any time.

The lifting unit with which the recliner upper portion can be moved in the vertical direction is supported by a support traverse rigidly connected to it at whose ends transversely directed legs are arranged. These legs in accordance with another improvement of the invention have, for detachable fastening to the support traverse, a centered screwbolt laterally offset from the lengthwise axis of the legs which after inserting the legs into recesses on the support traverse and rotating the legs about their lengthwise axis engage open slots in the support traverse. Thus the legs can be quickly fastened without further manipulation on the support traverse and provide a secure hold for the treatment recliner.

In order to adapt the treatment chair or the treatment recliner to the unevenness of the ground, another embodiment of the invention provides fixable eccentric disks rotating about the legs. Thus a height adjustment of the ends of the legs can be achieved quickly to conform to ground unevenness.

Additional improvements and advantages of the invention appear in the following description which refers to the drawings.

DESCRIPTION OF THE PREFERRED EMBODIMENTS

Figure 1:
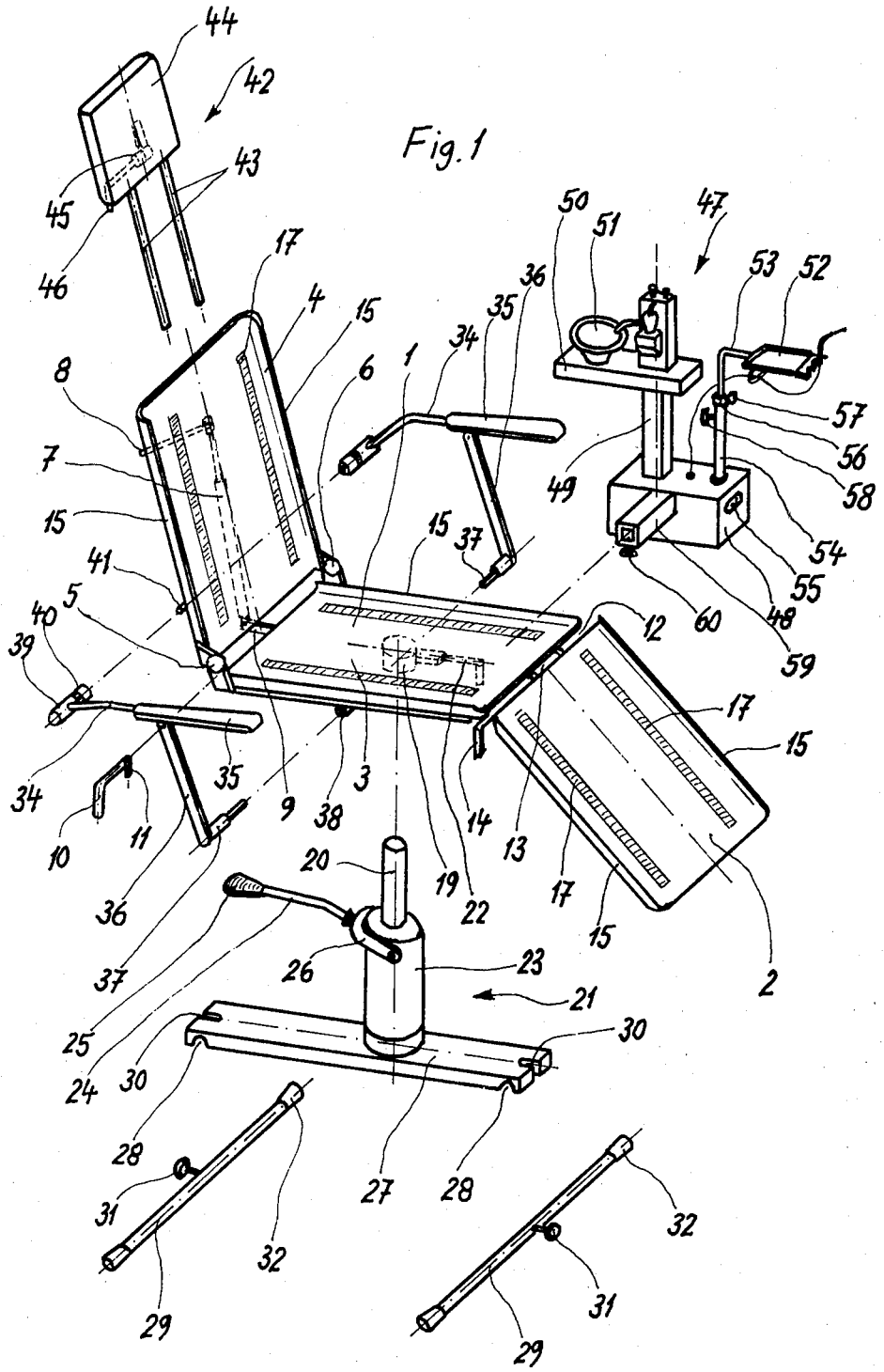
FIG. 1 shows a treatment recliner in a perspective schematic in the disassembled condition (exploded view) which clearly shows the capacity for dismantling into individual parts of individual assemblies.

FIG. 1 shows an exploded view of the treatment recliner as required especially in the dental field. The recliner upper portion 1 consists essentially of three parts, the foot part 2, the seating part 3 and the back part 4. The three parts mentioned are joined by hinges so that they can be placed into any angular position in a continuous fashion, hence in a seated position, as shown in FIG. 1, and in a lying position where the three parts 2, 3 and 4 are in one place. The hinges on both sides, with which the back part 4 is hinged to the seating part 3, have referral number 5 and 6. The hinges 5 and 6 are easily movable, while the fixing of the back part 4 in relation to the seating part 3 is achieved by a lockable pneumatic spring 7 which is fastened by one end to the back part 4 and is actuated via the control lever 8, while the other end of the pneumatic spring is hinged to the seating part 3; the seating part 3 has an extension 9 which extends rearwards and to which the pneumatic spring 7 is fastened by means of the locking pin 10. This locking pin 10 has the form of an angled pin and on one end has a safety tab 11 which can be turned by 90°; the safety tab, after the locking pin 10 has been inserted into the proper hole of extension 9 after the pneumatic spring 7 has been attached, is turned and thus an unintentional dropping out or pulling out of the locking pin 10 is prevented.

In the region of the hinged location 12 between the seating part 3 and the foot part 2 there is a click-stop adjustment 13 which can be actuated via the clamp lever 14. This click-stop adjustment 13 has two form- and force-locked engaging radial serrations which in the engaged position fix the foot part 3 in its angle position relative to the seating part. After loosening the clamp lever 14, the foot part 2 can be moved to any other position in accordance with the type of treatment.

As is clearly evident from FIG. 1, the recliner upper portion 1, hence the back part 4, the seating part 3 and the foot part 2, have laterally pulled-up rims. These pulled-up rims 15 form a restraint and prevent the cushion 16 shown in FIG. 2 from sliding off laterally from the recliner upper portion 1. At the same time, the rims 15 are an aid when placing the cushion 16 on the recliner upper portion such that the adhesive tapes attached to the topside of the back part 4, the seating part 3 and the foot part 2 come to exactly coincide with the corresponding adhesive tapes 18 on the bottom side of the cushion 16. These adhesive tapes 17 and 18 may be velcro tapes, i.e., there are synthetic bristles with outward pointing barbs so that the bristles of tapes 17 penetrate between the bristles of tapes 18 and adhere like a bur. Conversely, such a cushion 16 held on the recliner top portion 1 can be detached at any time from the recliner upper portion 1 without requiring special tools.

On the bottom side of the seating part 3 of the recliner upper portion 1 there is fastened a potlike cup 19 which engages the free end of piston 20 of the lifting device 21. After inserting the piston 20 in the cup, the piston can be clamped to the cup 19 by means of clamp lever 22. The lifting device 21 itself consists, in addition to the previously mentioned piston 20, of the lift cylinder 23 and the foot lever 24 which has a pedal 25 on its free end. By means of foot lever 24 which is hinged via a fork 26 to the lift cylinder 23 of the lifting device 21, the piston 20 can be raised or lowered, moving the recliner upper portion 1 which thus can be placed in the most beneficial working postion. Inside the lift cylinder 23—not further shown in the drawing—a lengthwise guide may be arranged so that during raising and lowering of the recliner upper portion the latter is secure against rotation.

The lifting device 21 is rigidly connected with the support traverse 27 and is held by it. The support traverse 27 has on its two ends transverse recesses 28 which are used for receiving legs 29. Also, in the region of the ends of the support traverse 27, in the lengthwise direction of the support traverse 27, there is a slot 30 open towards the outside. The legs 29 which are essentially tubular and run transversely to the support traverse 27, have screwbolts 31 located in their center to be manually turned. Further, the free ends of the legs 29 have rubber cups 32 which serve as feet.

After inserting the legs 29 in the recesses 28 of the support traverse 27, the leg 29 is turned so that the screwbolt 31 passes through the slot 30 and the screw head of the screwbolt 31 is on top. After tightening the screw 31, the legs 29 are held securely to the support traverse 27.

Figure 3:
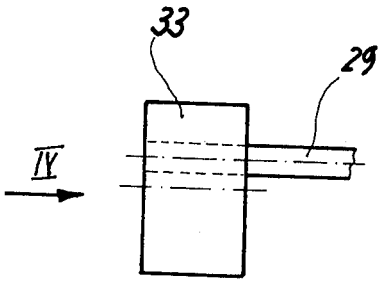
FIG. 3 shows an end of a leg with eccentric disk on an enlarged scale breakaway view.
Figure 4:
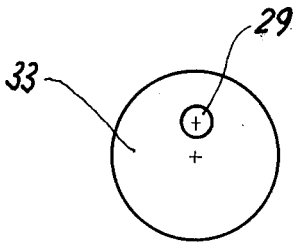
FIG. 4 shows a view in the direction of arrow IV in FIG. 3.

FIGS. 3 and 4 show a variation of the legs 29. The embodiment, shown in FIGS. 3 and 4, of legs 29 has no cups 32; rather, in the region of the free ends of legs 29 there are eccentric disks which can be locked in any position. By simply turning the eccentric disks 33, allowance can be made during installation of the treatment recliner for ground unevenness where a height adjustment corresponding to the double eccentricity between the eccentric disk 33 and the leg 29 can be made.

As shown in FIG. 1, side rests 34 are provided on the side of the recliner upper portion 1; these comprise an arm rest 35 and a support strut 36. The support strut 36 is hinged to the arm rest 35 and can be placed in any angle position, following the movement of the back and seating parts 4 and 3. The free end of the support struts 36 mounts trunnions 37 which engage matching sleeves 38 on the bottomside of the seating part 3. At the rear end of the arm rests 35 are cups 39 which are equipped with a threaded ring 40. These cups 39 are slid over trunnions 41 (only one is shown) arranged on the rear side of the back part 4 and held by means of the threaded ring 40. A separate fastening of the pin 37 inserted in the sleeve 38 thus becomes superfluous.

There also is provided a head part 42 having two holding struts 43. These holding struts 43 are inserted in sleeves (not shown) on the rear side of the back part 4 so that the head rest 42 is held securely to the back part 4. To adjust the inclination of the head rest 44 of the head support 42 there is a hinge 45 which can be locked by means of a click-stop adjustment, similar to the one described with the hinge between the seating part 3 and the foot part 2, in the set position which is done by means of a clamp lever 46.

The treatment recliner shown in FIG. 1 is intended especially for dental treatment. For this purpose a so-called sputum unit 47 is insertable on the recliner upper portion 1, on seating part 3. This sputum unit 47 consists of a connection box 48 which mounts the sputum vessel 51 resting on column 49 and the bracket 50, while an instrument depository 52 (tray) is held via carrier 53 and the vertical tube 54 on the connection box 48. The connection box mounts connections (not shown) for the quick-connect lines for water and air. There is also installed a receptacle 55 on the connection box 48 for supplying power to the drilling unit (not shown). Carrier 53 mounts a holder ring 56 which can be fixed via a screw 57 on the carrier 53, so that the carrier 53 and hence the instrument tray 52 are held at a certain elevation but pivotal relative to the vertical tube 54. To fix the position of the instrument tray 52 in relation to the pivotal angle, a manually operated adjustment screw 58 is arranged on vertical tube 54 so that a predetermined position of the instrument tray 52 can be fixed at any time.

On the connection box 48 of the sputum unit 47 a square tube 59 is arranged permanently which is provided with a manually operated adjustment screw 60; after inserting the square tube 59 in a matching square bar (not shown) on the seating part 3 and tightening the screw 60, the sputum unit 47 is securely connected to the treatment recliner. Instead of the sputum unit 47, other units required for surgical operations can be plugged or clamped to the recliner upper portion 1.

Figure 2:
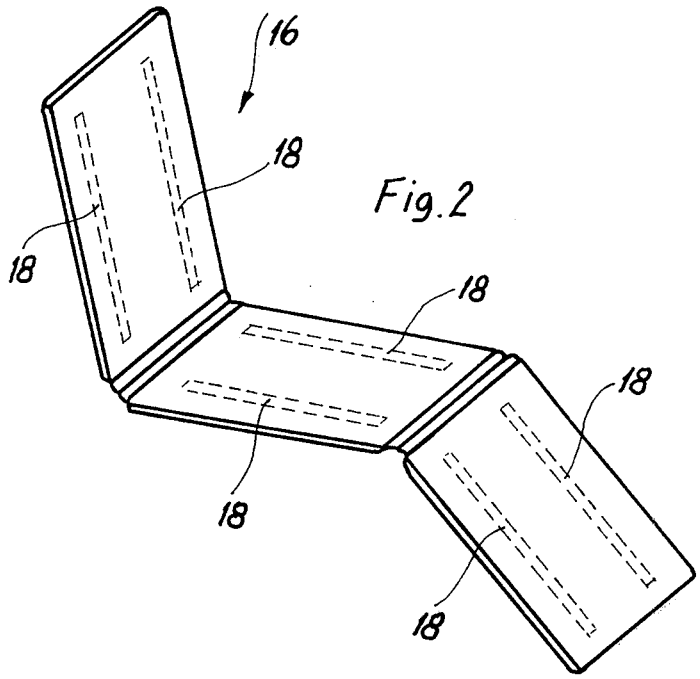
FIG. 2 shows a cushion for placing on the recliner upper portion of the recliner according to FIG. 1.

With regard to FIG. 2 it is pointed out that the cushion 16 consists of three parts which are essentially of the same dimensions as the three parts of the recliner upper portion 1 so that the cushion 16 can be easily placed on the topside of the recliner upper portion 1.

As is apparent from FIG. 1, the treatment recliner can be disassembled easily and without tools into its individual parts or into individual assemblies and the recliner upper portion 1 can be folded easily into a package so that the individual parts and assemblies including the sputum unit 47 and the cushion 16 can be accommodated in a transport box. For a complete treatment chair one could use a box whose outer dimensions are 800×600×500 mm. This shows that a complete treatment recliner or unit meeting all needs can be accommodated in a very small space so that it may be easily transported to any location, i.e., can be assembled and ready for treatment with a few minutes.

In case of doubt all described improvements shown in the drawing are to be considered as essential to the invention, either by themselves or in any meaningful combination.

I claim:

1. A transportable treatment recliner continuously adjustable in height and from a seating to a lying position, and rotary about a vertical axis, for medical, particularly dental or surgical care, comprising a recliner upper portion; a plurality of recliner attachment elements including arms and head rest and medical treatment equipment which are connected to the recliner by manually releasable clamp and plug connections which may be completely disassembled from said recliner manually and without tools, and accommodated in a transport container in a space-saving manner; releasable clamp and plug connections for fastening said attachment elements to said recliner upper portion; said recliner upper portion further comprising three hinged parts fixable at any angle relative to each other and capable of being folded into a flat package upon release of said clamp and plug connections, said three hinged parts comprising a foot part, a seating part hingedly connected to said foot part and a back part hingedly connected to said seating part; said recliner being accessible from all sides.

2. A treatment recliner as defined in claim 1 including a back part of said recliner upper portion, a control lever, a pneumatic spring lockable via said control lever to said back part; a seating part with extension, said pneumatic spring being hinged to a rear side of said back part and to said extension; a first click-stop adjustment; a foot part, said first click-stop adjustment being located between said seating part and said foot part; a first clamp lever; said click-stop adjustment being actuated by said first clamp lever.

3. A treatment recliner as defined in claim 2 including an angled pin and a turnable safety tab, said pneumatic spring being held on said extension by said angled pin with said turnable safety tab.

4. A treatment recliner as defined in claim 1 including a first click-stop adjustment having the form of positively-locked engaging radial serrations.

5. A treatment recliner as defined in claim 1 including laterally pulled-up rims, adhesive tapes and a cushion, said recliner upper portion having said pulled-up rims on its topside for detachable fastening of said cushions by said adhesive tapes, said adhesive tapes being located on topside of said recliner upper portion and on bottom side of said cushion.

6. A treatment recliner as defined in claim 5 wherein said adhesive tapes are velcro tapes.

7. A treatment recliner as defined in claim 5 wherein said cushion comprises three interconnected parts with dimensions corresponding to the dimensions of said three hinged parts of said recliner upper portion.

8. A treatment recliner as defined in claim 2 including side rests inserted on a side of said recliner upper portion.

9. A treatment recliner as defined in claim 8 wherein said side rests comprise arm rests inserted in said back part, and hingedly fastened support struts with free ends inserted in said seating part.

10. A treatment recliner as defined in claim 9 including transversely directed first trunnions on said back part; first cups at rear end of said arm rests, said first trunnions engaging said first cups and having threaded rings; second trunnions on said free ends of said support struts engaging sleeves arranged on said seating part.

11. A treatment recliner as defined in claim 2 including a piston of a lifting device; a second cup located on a bottom side of said seating part and engaging said piston; said piston supporting said recliner upper portion; said second cup being held by a clamp lever mounted on said second cup.

12. A treatment recliner as defined in claim 11 including a support traverse and legs; said lifting device being supported by said support traverse rigidly connected thereto; ends of said support traverse having said legs transversely directed thereto.

13. A treatment recliner as defined in claim 12 including screwbolts for detachably fastening said legs to said support traverse, said screwbolts being centrally located but laterally offset relative to lengthwise axes of said legs; recess means in said support traverse; said screwbolts engaging said support traverse after installing said legs in said recesses in said support traverse and rotating said legs about said lengthwise axes into slots.

14. A treatment recliner as defined in claim 12 including rotatable eccentric disks fixable at any position at the ends of said legs for compensating ground unevenness.

15. A treatment recliner as defined in claim 12 including a lengthwise guide for said piston inside said lifting device for securing against rotation while raising and lowering said recliner upper portion.

16. A treatment recliner as defined in claim 2 including a head rest, two holding struts and sleeves, said holding struts being insertable in said sleeves on said back part.

17. A treatment recliner as defined in claim 16 including a hinge with a second click-stop adjustment; a second clamp lever actuating said second click-stop adjustment for fixing inclination of said head rest.

18. A treatment recliner as defined in claim 2 including a sputum unit for dental treatment; a square tube and a square bar, said sputum unit being detachably mounted via said square tube on said square bar on said seating part; a knurled screw for fastening said square tube to said square bar.

19. A treatment recliner as defined in claim 18, said sputum unit including: a sputum vessel and an instrument tray; a connection box mounting said sputum vessel and said instrument tray; said connection box having quick-connect lines for water and air and an attached receptacle for a drilling unit.

20. A treatment recliner as defined in claim 19 including a vertical tube and an adjustable ring; an angled carrier holding said instrument tray and rotatably engaging said vertical tube, said vertical tube being fastened to said connection box, said adjustable ring being arranged on said carrier for adjusting the height, said vertical tube having a handscrew for securing said carrier.

* * * * *